US010172503B2

(12) United States Patent
Wei

(10) Patent No.: US 10,172,503 B2
(45) Date of Patent: Jan. 8, 2019

(54) INTELLIGENT CLOSESTOOL

(71) Applicant: BOE TECHNOLOGY GROUP CO., LTD., Beijing (CN)

(72) Inventor: Chuang Wei, Beijing (CN)

(73) Assignee: BOE TECHNOLOGY GROUP CO., LTD. (CN)

( * ) Notice: Subject to any disclaimer, the term of this patent is extended or adjusted under 35 U.S.C. 154(b) by 0 days.

(21) Appl. No.: 15/683,582

(22) Filed: Aug. 22, 2017

(65) Prior Publication Data

US 2018/0055295 A1 Mar. 1, 2018

(30) Foreign Application Priority Data

Aug. 25, 2016 (CN) ..... 2016 1 0726288

(51) Int. Cl.
*A47K 13/10* (2006.01)
*E03D 5/04* (2006.01)

(52) U.S. Cl.
CPC ..... *A47K 13/10* (2013.01); *E03D 5/04* (2013.01)

(58) Field of Classification Search
CPC ..... A47K 13/10; E03D 5/04
USPC ..... 4/234
See application file for complete search history.

(56) References Cited

U.S. PATENT DOCUMENTS 7,051,381 B2 * 5/2006 Furukawa ..... A47K 13/10 4/246.1
8,082,607 B2 * 12/2011 Matsushita ..... A47K 13/24 4/302
2007/0056082 A1 3/2007 Scheel

FOREIGN PATENT DOCUMENTS

| | | | |
|---|---|---|---|
| CN | 1401863 | A | 3/2003 |
| CN | 101082227 | A | 12/2007 |
| CN | 203861110 | U | 10/2014 |
| CN | 104134618 | A | 11/2014 |
| CN | 204797725 | U | 11/2015 |
| CN | 204862937 | U | 12/2015 |
| CN | 106223435 | A | 12/2016 |

OTHER PUBLICATIONS

First Office Action for Chinese Application No. 201610726288.X, dated Sep. 28, 2017, 6 Pages.

* cited by examiner

*Primary Examiner* — Huyen Le
(74) *Attorney, Agent, or Firm* — Brooks Kushman P.C.

(57) ABSTRACT

The present disclosure provides an intelligent closestool including a closestool stand, a closestool seat, a closestool lid, a sensor and a controller. The sensor is configured to sense whether there is an object approaching, or moving away from, the closestool stand, and in the case that there is an object approaching the closestool stand, detect a standing direction of the object relative to the closestool stand. The controller is configured to open/close the closestool lid in the case that the sensor has sensed that the object approaches/moves away from the closestool stand; flip the closestool seat up in the case that the sensor has sensed that the object faces the closestool stand, and flip the closestool seat down in the case that the sensor has sensed that the object turns his or her back to the closestool stand.

13 Claims, 4 Drawing Sheets

INTELLIGENT CLOSESTOOL

CROSS-REFERENCE TO RELATED APPLICATION

This application claims priority to Chinese Patent Application No. 201610726288.X filed on Aug. 25, 2016, which is incorporated herein by reference in its entirety.

TECHNICAL FIELD

The present disclosure relates to the field of sanitary product technology, and more particularly to an intelligent closestool.

BACKGROUND

In modern society, closestools have been popular to various families. A closestool mainly includes a closestool stand, a closestool seat, a closestool lid and a water storage system. The closestool seat exists because of a difference of excretion manners between men and women. Specifically, when having a bowel movement, there is no difference between men and women, both of men and women need to sit on the closestool seat. However, when urinating, men need to stand and flip the closestool seat up in case the closestool seat is contaminated by excreted urine, while women still need to sit on the closestool seat.

Currently, the closestool, the closestool seat and the closestool lid all need to be flipped or opened manually by a person himself or herself. In the case that flipping the closestool seat manually, hands may be stained with urine on the closestool stand. Some of men even are unwilling to flip closestool seat up when urinating and excrete urine directly, causing a severe contamination to the closestool seat.

SUMMARY

In view of this, the present disclosure provides in at least one embodiment an intelligent closestool to avoid opening the closestool lid or flipping the closestool seat up manually.

Therefore, the present disclosure in at least one embodiment provides an intelligent closestool including a closestool stand, a closestool seat and a closestool lid, and further including a sensor and a controller. The sensor is configured to sense whether there is an object approaching, or moving away from, the closestool stand, and in the case that there is an object approaching the closestool stand, detect a standing direction of the object relative to the closestool stand; the controller is configured to: open the closestool lid in the case that the sensor has sensed that the object approaches the closestool stand, and close the closestool lid in the case that the sensor has sensed that the object moves away from the closestool stand; flip the closestool seat up in the case that the sensor has sensed that the object faces the closestool stand, and flip the closestool seat down in the case that the sensor has sensed that the object turns his or her back to the closestool stand.

In some embodiments of the present disclosure, the sensor includes an infrared sensor and a side face detector. The infrared sensor is configured to sense whether there is an object approaching, or moving away from, the closestool stand; and the side face detector is configured to, after the infrared sensor has sensed that there is an object approaching the closestool stand, detect the standing direction of the object relative to the closestool stand.

In some embodiments of the present disclosure, the side face detector is configured to, after the infrared sensor has sensed that there is an object approaching the closestool stand, detect the standing direction of the object relative to the closestool stand at predetermined intervals.

In some embodiments of the present disclosure, the side face detector includes an image collector, an image preprocessor and a grayscale detector. The image collector is configured to, after the infrared sensor has sensed that there is an object approaching the closestool stand, collect a side face image of the object at pre-determined intervals. The image preprocessor is configured to denoise the collected side face image; and the grayscale detector is configured to segment the denoised image according to grayscales, and determine whether the object faces the closestool stand according to a grayscale variation direction of the segmented pixels.

In some embodiments of the present disclosure, the grayscale detector is further configured to: determine a grayscale segmentation threshold through an iteration method; record pixels having a grayscale value greater than the segmentation threshold in the denoised image as a first kind of pixels, and record pixels having a grayscale value less than or equal to the segmentation threshold in the denoised image as a second kind of pixels; for each of the second kind of pixel, taking the first kind of pixels adjacent to the second kind of pixel as grayscale direction pixels, calculate angles each of which is formed between a first direction and a second direction and obtained by rotating from the first direction to the second direction along a predetermined rotation direction, wherein the first direction is a right-above direction of the side face image and the second direction is a direction of the second kind of pixel pointing to the respective grayscale direction pixels, then calculate a first average of the angles; calculate a second average of the calculated first averages for the respective second kind of pixels, as a judging angle; judge whether the judging angle is greater than or equal to a first pre-determined angle and less than or equal to a second pre-determined angle; if the case of yes, determine that the object faces the closestool stand.

In some embodiments of the present disclosure, the predetermined rotation direction is clockwise in the case that the closestool is located on a right side of the first direction and the predetermined rotation direction is counterclockwise in the case that the closestool is located on a left side of the first direction.

In some embodiments of the present disclosure, the first pre-determined angle is 90 degrees, and the second predetermined angle is 180 degrees.

In some embodiments of the present disclosure, the grayscale detector is further configured to: calculate T(n+1) according to an iterative formula $$T(n+1) = \frac{\sum_{i=0}^{T(n)} iC[i]}{\sum_{i=0}^{T(n)} C[i]} + \frac{\sum_{i=T(n)+1}^{255} iC[i]}{\sum_{i=T(n)+1}^{255} C[i]},$$

compare T(n+1) with T(n) and continue to perform the iterative calculation until T(n+1)=T(n), and then take the value of T(n+1) acquired in the case that the iterative calculation is stopped as the grayscale segmentation threshold; where n is an integer greater than 0, C[i] is a quantity of pixels having a grayscale value i in the denoised image, i is an integer from 0 to 255, and $$T(1) = \frac{255}{2}.$$

In some embodiments of the present disclosure, the controller, the image preprocessor and the grayscale detector are all embedded in the closestool stand.

In some embodiments of the present disclosure, the above intelligent closestool further includes a wireless transmitter. The wireless transmitter is configured to send the side face image collected by the image collector to the image preprocessor.

In some embodiments of the present disclosure, the wireless transmitter is further configured to send information about the object approaching or moving away from the closestool stand sensed by the infrared sensor to the controller.

In some embodiments of the present disclosure, the controller includes a driving motor, a flipping gear and a transmission shaft.

In some embodiments of the present disclosure, the flipping gear is fixed on a junction of the closestool lid and the closestool seat, and in the case that the controller has received information about the object approaching the closestool stand from the sensor, the driving motor controls the flipping gear by the transmission shaft to open the closestool lid; in the case that the controller has received information about the object facing the closestool stand from the sensor, the driving motor controls the flipping gear by the transmission shaft to rotate to flip the closestool seat up; in the case that the controller has received information about the object having his or her back on the closestool stand from the sensor, the driving motor controls the flipping gear by the transmission shaft to rotate to flip the closestool seat down; and in the case that the controller has received information about the object moving away from the closestool stand from the sensor, the driving motor controls the flipping gear by the transmission shaft to rotate to close the closestool lid.

The benefit effect of the present disclosure is as follows. The intelligent closestool provided by the present disclosure in at least one embodiment includes a closestool stand, a closestool seat, a closestool lid, a sensor and a controller. The sensor is configured to sense whether there is an object approaching, or moving away from, the closestool stand, and in the case that there is an object approaching the closestool stand, detect a standing direction of the object relative to the closestool stand; the controller is configured to open the closestool lid in the case that the sensor has sensed that the object approaches the closestool stand, and close the closestool lid in the case that the sensor has sensed that the object moves away from the closestool stand; flip the closestool seat up in the case that the sensor has sensed that the object faces the closestool stand, and flip closestool seat down in the case that the sensor has sensed that the object turns his or her back to the closestool stand. Thus, it is able to avoid opening the closestool lid and flipping the closestool seat manually.

DETAILED DESCRIPTION

Figure 1:
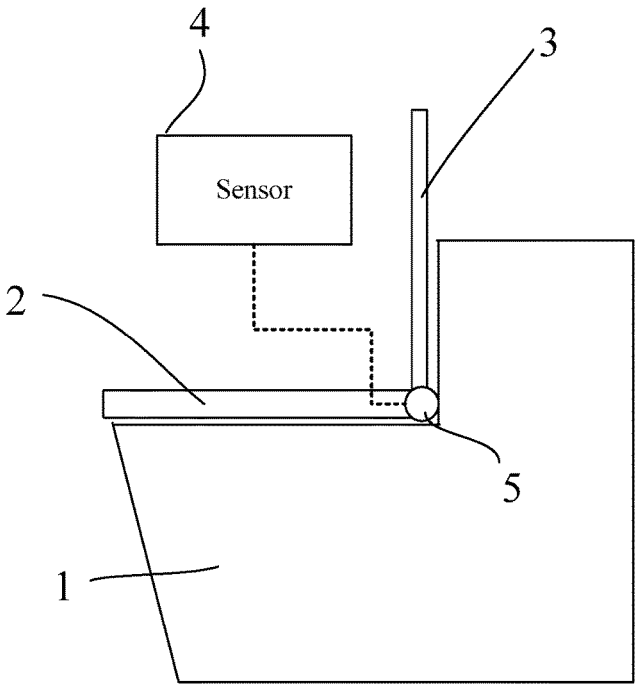
FIG. 1 is a schematic diagram showing an intelligent closestool provided by the present disclosure in some embodiments.

In order to make the objects, the technical solutions and the advantages of the present disclosure more apparent, the present disclosure will be described hereinafter in a clear and complete manner in conjunction with the drawings and embodiments. Obviously, the following embodiments are merely a part of, rather than all of, the embodiments of the present disclosure, and based on these embodiments, a person skilled in the art may obtain the other embodiments, which also fall within the scope of the present disclosure.

Shapes and sizes of each component in the drawings do not reflect actual ratios, instead, merely aim to schematically illustrate contents of the present disclosure.

An intelligent closestool provided by the present disclosure in at least one embodiment, as shown in FIG. 1, includes a closestool stand 1, a closestool seat 2 and a closestool lid 3, and further includes a sensor 4 and a controller 5. The sensor 4 is configured to: sense whether there is an object approaching, or moving away from, the closestool stand 1, and in the case that there is an object approaching the closestool stand 1, detect a standing direction of the object relative to the closestool stand 1. The controller 5 is configured to: open the closestool lid 3 in the case that the sensor 4 has sensed that the object approaches the closestool stand 1, and close the closestool lid 3 in the case that the sensor 4 has sensed that the object moves away from the closestool stand 1; flip the closestool seat 2 up in the case that the sensor 4 has sensed that the object faces the closestool stand 1, and flip the closestool seat 2 down in the case that the sensor 4 has sensed that the object turns his or her back to the closestool stand 1.

The above intelligent closestool provided by the present disclosure in at least one embodiment includes a closestool stand, a closestool seat, a closestool lid, a sensor and a controller. The sensor is configured to sense whether there is an object approaching, or moving away from, the closestool stand, and in the case that there is an object approaching the closestool stand, detect a standing direction detection of the object relative to the closestool stand. The controller is configured to open the closestool lid in the case that the sensor has sensed that the object approaches the closestool stand, and close the closestool lid in the case that the sensor has sensed that the object moves away from the closestool stand; flip the closestool stand up in the case that the sensor has sensed that the object faces the closestool stand, and flip the closestool seat down in the case that the sensor has sensed that the object turns his or her back to the closestool stand.

In the embodiments of the present disclosure, the object mainly refers to a person, which shall not be limited herein.

Figure 2:
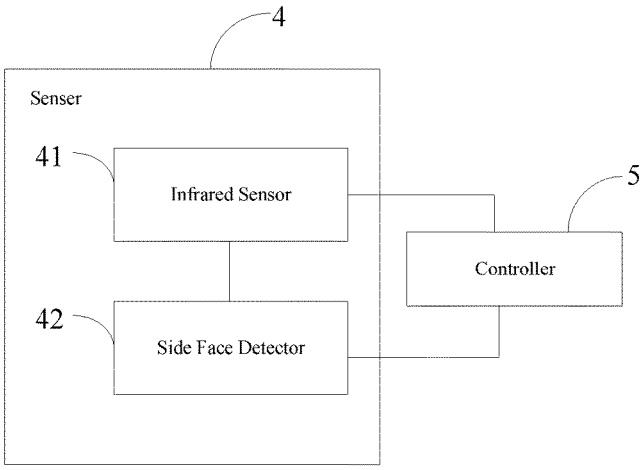
FIG. 2 is a schematic diagram showing a sensor in the intelligent closestool provided by the present disclosure in some embodiments.

In some embodiments, as shown in FIG. 2, the sensor 4 includes an infrared sensor 41 and a side face detector 42.

The infrared sensor 41 is configured to sense whether there is an object approaching, or moving away from, the closestool stand; and the side face detector 42 is configured to, after the infrared sensor 41 has sensed that there is an object approaching the closestool stand, detect the standing direction of the object relative to the closestool stand. The infrared sensor 41 herein may be a common human infrared detecting device, and in the case that there is a person enters a sensing range, the sensor may detect a variation of a human infrared spectrum so as to provide a corresponding signal.

In some embodiments, the side face detector is configured to, after the infrared sensor has sensed that there is an object approaching the closestool stand, detect the standing direction of the object relative to the closestool stand at predetermined intervals. Obviously, the side face detector may also detect the standing direction of the object relative to the closestool stand in real time, but this will result in an increase in quantities and difficulties of data processing, and increasing the costs.

Figure 3:
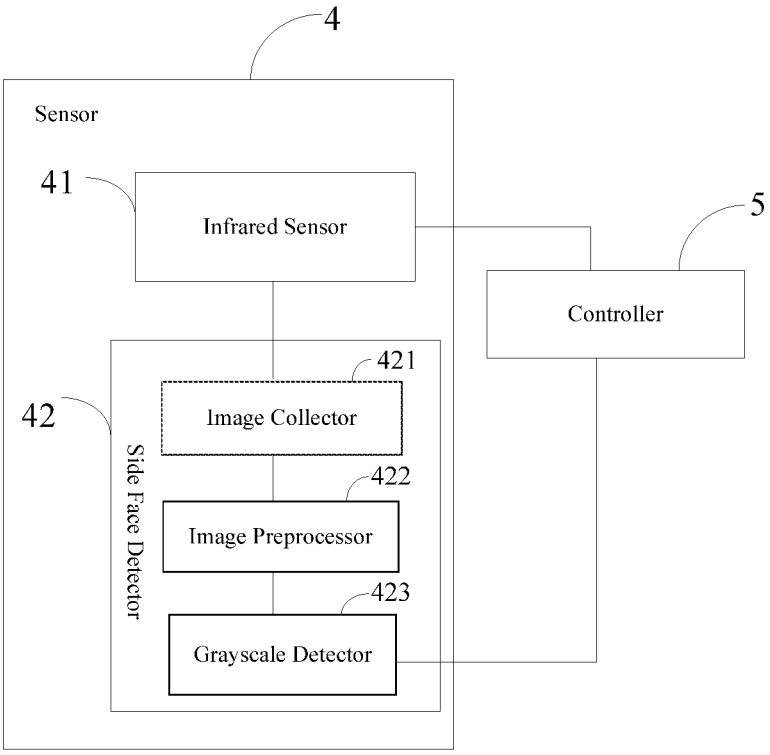
FIG. 3 is a schematic diagram showing a sensor in the intelligent closestool provided by the present disclosure in some embodiments.

In some embodiments, as shown in FIG. 3, the side face detector 42 includes an image collector 421, an image preprocessor 422 and a grayscale detector 423. The image collector 421 is configured to, after the infrared sensor 41 has sensed that there is an object approaching the closestool stand, collect a side face image of the object at predetermined intervals. The image preprocessor 422 is configured to denoise the collected side face image. And the grayscale detector 423 is configured to segment the denoised image according to grayscales, and determine whether the object faces the closestool stand according to a grayscale variation direction of the segmented pixels. In a specific implementation, the image collector herein may be a common image collecting device, such as a camera or an image sensor, and the image preprocessor 422 and the grayscale detector herein may be a processor or an integrated circuit capable of realizing the above functions.

In the above intelligent closestool provided by the present disclosure in at least one embodiment, besides information about the side face, the side face image collected by the image collector further includes other noises, such as backgrounds, therefore the collected side face image needs to be denoised by the image preprocessor so as to remove information in the side face image, such as backgrounds, to improve the image quality.

In a specific implementation, the side face image can be mainly divided into two parts, i.e., a hair region and a skin region. According to experiences, in the case that a person faces the closestool stand, an area of the skin region is far larger than an area of the hair region. Therefore, whether the person faces the closestool stand may be detected according to grayscale variation direction. Moreover, since there exists an obvious grayscale difference between the hair region and the skin region, the two regions may be segmented through a threshold segmentation method.

Figure 4:
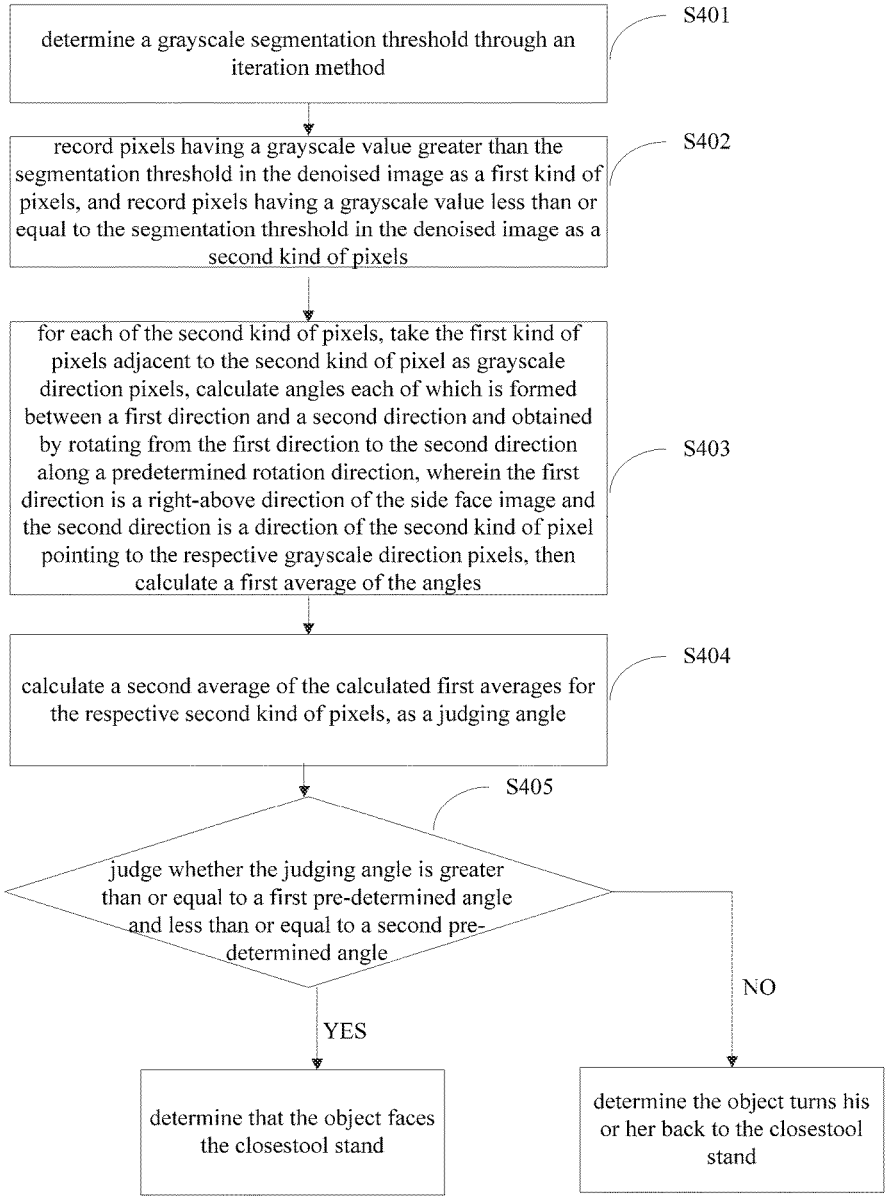
FIG. 4 is a working flowchart of a grayscale detector in the intelligent closestool provided by the present disclosure in some embodiments.

Therefore, in an embodiment of the present disclosure, as shown in FIG. 4, the grayscale detector is configured to perform the following S401 to S405.

S401, determine a grayscale segmentation threshold through an iteration method.

S402, record pixels having a grayscale value greater than the segmentation threshold in the denoised image as a first kind of pixels, and recording pixels having a grayscale value less than or equal to the segmentation threshold in the denoised image as a second kind of pixels.

S403, for each of the second kind of pixels, take the first kind of pixels adjacent to the second kind of pixel as grayscale direction pixels, calculate angles each of which is formed between a first direction and a second direction and obtained by rotating from the first direction to the second direction along a predetermined rotation direction, wherein the first direction is a right-above direction of the side face image and the second direction is a direction of the second kind of pixel pointing to the respective grayscale direction pixels, then calculate a first average of the angles. Here, the predetermined rotation direction may be clockwise in the case that the closestool is located on a right side of the first direction; and the predetermined rotation direction may be counterclockwise in the case that the closestool is located on a left side of the first direction.

Figure 5:
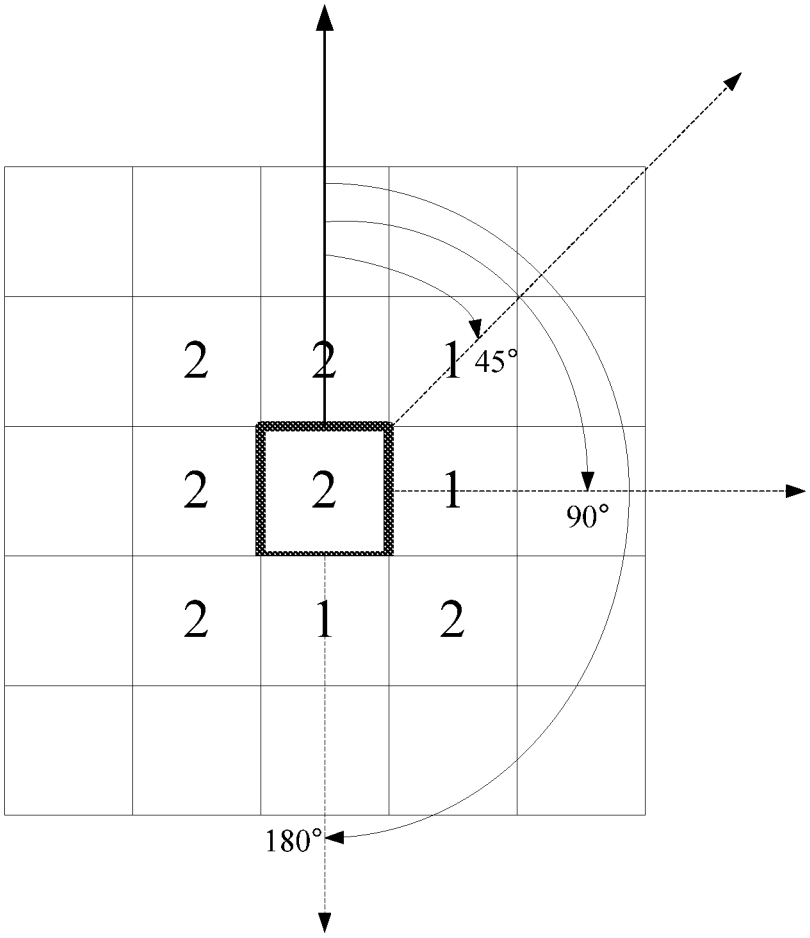
FIG. 5 is a presentation view showing determination of a grayscale variation direction for one of a second kind of pixels by the grayscale detector in the intelligent closestool provided by the present disclosure in some embodiments.

Taking the second kind of pixel 2 located in a center position in FIG. 5 as an example, there are eight pixels adjacent to the second kind of pixel 2. Three of the eight pixels are first kind of pixels 1, and the rest five pixels are second kind of pixels 2. These three first kind of pixels 1 are grayscale direction pixels, and angles by each of which a direction of the second kind of pixel 2 locating in the center position pointing to each of the grayscale direction pixels (directions pointed by dotted arrows in FIG. 5) rotates from a right above direction of the side face image (a direction pointed by a solid arrow in FIG. 5) towards to a direction facing the closet are 45 degrees, 90 degrees and 180 degrees. A first average of the 45 degrees, 90 degrees and 180 degrees is calculated, and the average of 105 degrees is taken as a judging angle.

S404, calculate a second average of the calculated first averages for the respective second kind of pixels, as a judging angle.

S405, judge whether the judging angle is greater than or equal to a first pre-determined angle and less than or equal to a second pre-determined angle; in the case of yes, determine that the object faces the closestool stand; and in the case of not, determine the object turns his or her back to the closestool stand.

In a specific implementation, the first pre-determined angle and the second pre-determined angle may be initialized and set at factory according to experiences. For example, the first pre-determined angle may be 90 degrees, and the second pre-determined angle may be 180 degrees. The first pre-determined angle and the second pre-determined angle may also be set by a user himself or herself. In general, according to experiences, when a man urinates facing the closestool, an angle of raising head is in the range of 0 degree~90 degrees, and an angle of lowering head is in the range of 180 degrees-270 degrees. Therefore, for the above intelligent closestool provided by the present disclosure in at least one embodiment, values of the first pre-determined angle may be in the range of 0 degree~90 degrees, and values of the second pre-determined angle may be in the range of 180 degrees-270 degrees, which shall not be limited herein.

In a specific implementation, in the intelligent closestool according to at least one embodiment of the present disclosure, the grayscale detector is further configured to calculate T(n+1) according to an iterative formula $$T(n+1) = \frac{\sum_{i=0}^{T(n)} iC[i]}{\sum_{i=0}^{T(n)} C[i]} + \frac{\sum_{i=T(n)+1}^{255} iC[i]}{\sum_{i=T(n)+1}^{255} C[i]},$$

compare T(n+1) with T(n) and continue to perform the iterative calculation until T(n+1)=T(n), and then take the value of T(n+1) acquired in the case that the iterative calculation is stopped as the grayscale segmentation threshold; where n is an integer greater than 0, C[i] is a quantity of pixels having a grayscale value i in the denoised image, i is an integer from 0 to 255, and $$T(1) = \frac{255}{2}.$$

In some embodiments of the present disclosure, the controller, the image preprocessor and the grayscale detector are all embedded in the closestool stand.

Furthermore, the above intelligent closestool provided by the present disclosure in at least one embodiment further includes a wireless transmitter. The wireless transmitter is configured to send the side face image collected by the image collector to the image preprocessor. The wireless transmitter is connected to the image collector, and may be a short-range wireless transmission device in the related art, such as a Bluetooth device, an infrared device or a WiFi communication device.

Furthermore, in some embodiments of the present disclosure, the wireless transmitter is further configured to send information about the object approaching or moving away from the closestool stand sensed by the infrared sensor to the controller. In this case, the wireless transmitter is further connected to the infrared sensor.

Furthermore, the intelligent closestool according to at least one embodiment of the present disclosure further includes a power supply unit for providing power for the sensor and the controller.

In some embodiments of the present disclosure, the infrared sensor is embedded in a wall at a position facing the side of the object such that the infrared sensor determines whether there is an object approaching, or moving away from, the closestool stand by detecting an infrared spectrum variation of the object.

Furthermore, in some embodiments, the image collector is embedded in the wall at a position facing the side of the object, and arranged under the infrared sensor.

Furthermore, in some embodiments, the power supply unit and the wireless transmitter may also all be embedded in the wall, which shall not be limited herein.

In some embodiments of the present disclosure, the controller includes a driving motor, a flipping gear and a transmission shaft.

In some embodiments of the present disclosure, the flipping gear is fixed on a junction of the closestool lid and the closestool seat so as to control both the closestool lid and the closestool seat. In this way, in the case that the controller has received information about a person approaching the closestool stand from the sensor, the driving motor controls the flipping gear by the transmission shaft to rotate a certain degree clockwise to open the closestool lid. After that, in the case that the controller has received information about the person facing the closestool stand from the sensor, the driving motor controls the flipping gear by the transmission shaft to continue to rotate to flip the closestool seat up. In the case that the controller has received information about the person having his or her back on the closestool stand from the sensor, the driving motor controls the flipping gear by the transmission shaft to rotate counterclockwise to flip the closestool seat down; in the case that the controller has received information about the person moving away from the closestool stand from the sensor, the driving motor controls flipping gear by the transmission shaft to continue to rotate to close the closestool lid.

The above intelligent closestool provided by the present disclosure in at least one embodiment includes a closestool stand, a closestool seat, a closestool lid, a sensor and a controller. The sensor is configured to sense whether there is an object approaching, or moving away from, the closestool stand, and in the case that there is an object approaching the closestool stand, detect a standing direction of the object relative to the closestool stand. The controller is configured to: open the closestool lid in the case that the sensor has sensed that the object approaches the closestool stand, and close the closestool lid in the case that the sensor has sensed that the object moves away from the closestool stand; flip the closestool seat up in the case that the sensor has sensed that the object faces the closestool stand, and flip the closestool seat down in the case that the sensor has sensed that the object turns his or her back to the closestool stand. Thus, it is able to avoid opening the closestool lid and flipping the closestool seat manually.

Obviously, a person skilled in the art may make improvements and modifications without departing from the principle and the scope of the present disclosure, and in the case that these improvements and modifications belong to what the present disclosure claims and an equivalent technical scope thereof, the present disclosure shall also intend to include these improvements and modifications.

What is claimed is:

1. An intelligent closestool, comprising a closestool stand, a closestool seat and a closestool lid, and further comprising a sensor and a controller; wherein the sensor is configured to sense whether there is an object approaching, or moving away from, the closestool stand, and in the case that there is an object approaching the closestool stand, detect a standing direction of the object relative to the closestool stand;

the controller is configured to: open the closestool lid in the case that the sensor has sensed that the object approaches the closestool stand, and close the closestool lid in the case that the sensor has sensed that the object moves away from the closestool stand; flip the closestool seat up in the case that the sensor has sensed that the object faces the closestool stand, and flip the closestool seat down in the case that the sensor has sensed that the object turns his or her back to the closestool stand.

2. The intelligent closestool according to claim 1, wherein the sensor comprises an infrared sensor and a side face detector; wherein the infrared sensor is configured to sense whether there is an object approaching, or moving away from, the closestool stand; and the side face detector is configured to, after the infrared sensor has sensed that there is an object approaching the closestool stand, detect the standing direction of the object relative to the closestool stand.

3. The intelligent closestool according to claim 2, wherein the side face detector is further configured to, after the infrared sensor has sensed that there is an object approaching the closestool stand, detect the standing direction of the object relative to the closestool stand at predetermined intervals.

4. The intelligent closestool according to claim 3, wherein the side face detector comprises an image collector, an image preprocessor and a grayscale detector;

the image collector is configured to, after the infrared sensor has sensed that there is an object approaching the closestool stand, collect a side face image of the object at pre-determined intervals;

the image preprocessor is configured to denoise the collected side face image; and the grayscale detector is configured to segment the denoised side face image according to grayscales, and determine whether the object faces the closestool stand according to a grayscale variation direction of the segmented pixels.

5. The intelligent closestool according to claim 4, wherein the grayscale detector is further configured to:

determine a grayscale segmentation threshold through an iteration method;

record pixels having a grayscale value greater than the segmentation threshold in the denoised image as a first kind of pixels, and record pixels having a grayscale value less than or equal to the segmentation threshold in the denoised image as a second kind of pixels;

for each of the second kind of pixels, taking the first kind of pixels adjacent to the second kind of pixel as grayscale direction pixels, calculate angles each of which is formed between a first direction and a second direction and obtained by rotating from the first direction to the second direction along a predetermined rotation direction, wherein the first direction is a right-above direction of the side face image and the second direction is a direction of the second kind of pixel pointing to the respective grayscale direction pixels, then calculate a first average of the angles;

calculate a second average of the calculated first averages for the respective second kind of pixels, as a judging angle;

judge whether the judging angle is greater than or equal to a first pre-determined angle and less than or equal to a second pre-determined angle;

in the case that the judgment result is yes, determine that the object faces the closestool stand; and in the case of not, determine the object turns his or her back on the closestool stand.

6. The intelligent closestool according to claim 5, wherein the predetermined rotation direction is clockwise in the case that the closestool is located on a right side of the first direction; and the predetermined rotation direction is counterclockwise in the case that the closestool is located on a left side of the first direction.

7. The intelligent closestool according to claim 6, wherein the first pre-determined angle is 90 degrees, and the second pre-determined angle is 180 degrees.

8. The intelligent closestool according to claim 5, wherein the grayscale detector is further configured to:

calculate T(n+1) according to an iterative formula $$T(n+1) = \frac{\sum_{i=0}^{T(n)} iC[i]}{\sum_{i=0}^{T(n)} C[i]} + \frac{\sum_{i=T(n)+1}^{255} iC[i]}{\sum_{i=T(n)+1}^{255} C[i]},$$

compare T(n+1) with T(n) and continue to perform the iterative calculation until T(n+1)=T(n), and then take the value of T(n+1) acquired in the case that the iterative calculation is stopped as the grayscale segmentation threshold; where n is an integer greater than 0, C[i] is a quantity of pixels having a grayscale value i in the denoised image, i is an integer from 0 to 255, and $$T(1) = \frac{255}{2}.$$

9. The intelligent closestool according to claim 4, wherein the controller, the image preprocessor and the grayscale detector are all embedded in the closestool stand.

10. The intelligent closestool according to claim 9, further comprising a wireless transmitter, wherein the wireless transmitter is configured to send the side face image collected by the image collector to the image preprocessor.

11. The intelligent closestool according to claim 10, wherein the wireless transmitter is further configured to send information about the object approaching or moving away from the closestool stand sensed by the infrared sensor to the controller.

12. The intelligent closestool according to claim 1, wherein the controller comprise a driving motor, a flipping gear and a transmission shaft.

13. The intelligent closestool according to claim 12, wherein the flipping gear is fixed on a junction of the closestool lid and the closestool seat, and the controller is further configured to receive information about the object from the sensor; and in the case that the controller has received information about the object approaching the closestool stand from the sensor, the driving motor controls the flipping gear by the transmission shaft to rotate to open the closestool lid;

in the case that the controller has received information about the object facing the closestool stand from the sensor, the driving motor controls the flipping gear by the transmission shaft to rotate to flip the closestool seat up;

in the case that the controller has received information about the object having his or her back on the closestool stand from the sensor, the driving motor controls the flipping gear by the transmission shaft to rotate to flip the closestool seat down; and in the case that the controller has received information about the object moving away from the closestool stand from the sensor, the driving motor controls the flipping gear by the transmission shaft to rotate to close the closestool lid.

* * * * *